United States Patent [19]

Racine et al.

[11] Patent Number: 4,613,432

[45] Date of Patent: Sep. 23, 1986

[54] PULP SCREEN

[75] Inventors: Bill A. Racine, Hacienda Heights; Marvin D. Hixson, Manhattan Beach; Gene A. Huber, Los Angeles, all of Calif.

[73] Assignee: Sweco, Incorporated, Los Angeles, Calif.

[21] Appl. No.: 667,060

[22] Filed: Nov. 1, 1984

Related U.S. Application Data

[63] Continuation of Ser. No. 477,064, Mar. 21, 1983, abandoned.

[51] Int. Cl.[4] ..... B07B 1/28

[52] U.S. Cl. ..... 209/254; 209/269; 209/332; 209/275

[58] Field of Search ..... 209/274, 275, 332, 281, 209/326, 325, 331, 254, 250, 271, 269, 268, 243, 244

[56] References Cited

U.S. PATENT DOCUMENTS

| | | | |
|---|---|---|---|
| 777,703 | 12/1904 | Traylor | 209/271 |
| 2,312,969 | 3/1943 | Jönsson | 209/269 |
| 2,632,366 | 3/1953 | Ahlfors | 209/269 |
| 2,930,819 | 8/1960 | Holman et al. | 209/332 |
| 3,035,700 | 5/1962 | McCausland | 209/332 |
| 3,143,494 | 8/1964 | Leeman | 209/281 |
| 3,220,546 | 11/1965 | Gardner | 209/332 |
| 3,473,660 | 10/1969 | McKibben et al. | 209/332 |
| 3,501,002 | 3/1970 | Talley | 209/332 |
| 3,616,906 | 11/1971 | Miller et al. | 209/325 |
| 3,720,316 | 3/1973 | Riesbeck et al. | 209/254 |

*Primary Examiner*—S. Leon Bashore
*Assistant Examiner*—Wm. Bond
*Attorney, Agent, or Firm*—Lyon & Lyon

[57] ABSTRACT

Separating equipment having a partially submerged vibratory screen in a screening device wherein oversized particles are induced to flow in a spiral direction outwardly from a central submerged area of the screen. A low velocity inlet manifold is employed centrally above the screen and a spray mechanism directs clearing spray to a peripheral area outwardly of the submerged portion of the screen. The screen is submerged by means of a chamber which extends outwardly above the lower most portion of the concaved partially submerged screen. The preferred embodiments specifically contemplates the screening of water borne wood pulp for the paper industry.

6 Claims, 4 Drawing Figures

PULP SCREEN

This application is a continuation of application Ser. No. 477,064 filed Mar. 21, 1983, now abandoned.

BACKGROUND OF THE INVENTION

The field of the present invention is vibratory separating equipment and more particularly equipment suited for the screening of course material from liquid borne solids.

Certain screening operations, particularly those involving liquid borne materials, are best conducted with a partially submerged screen. On the submerged portion of the screen, blinding and clumping are generally avoided. Furthermore, the suspended material generally cannot dry out or otherwise be separated from the carrying liquid. By employing a partially submerged screen, and by employing vibratory motion of that screen, the oversized material which is screened from the liquid-solid mixture is slowly moved from the submerged portion of the screen and discharged without loss of suspended material or liquid.

The foregoing principles have been employed in the paper industry for the screening of water borne pulp. One such early device employed in this industry includes a rectangular, vibrated open vat having a curved screen extending through a portion of its length beneath a water level maintained in the vat. Translational vibration moves the material screened from the pulp mixture up the incline of the screen from the water to an outlet. The water borne pulp is discharged from the vat below the screen.

The operation of such screening systems has been found generally acceptable. However, heretofore such partially submerged screening systems have not incorporated the more modern, efficient and versatile screening devices employing rotational and radial motion rather than simple translation. The modern screening device generally includes a horizontal screen mounted in a sprung frame. Eccentric weights are arranged to induce vibrational motion which in turn causes the material on the screen to move in an outward spiral. Such motion gives an extended path of travel and allows for easy collection of the oversized material. Furthermore, the path of motion may be easily varied to increase or decrease residence time. Such modern devices are also more amenable to advantageous material feed and cleaning spray arrangements.

Vibratory separators of a type similar in overall arrangement to the present invention but lacking the partially submerged feature are shown in the series of Miller et al, U.S. Pat. Nos. 2,696,302; 2,753,999; 2,777,578; and 2,714,961, the McCausland, U.S. Pat. No. 3,035,700, and the Wright, Jr., et al, U.S. Pat. No. 3,029,946. See also Miller et al, U.S. Pat. No. 3,616,906. The foregoing patents are incorporated herein by reference.

SUMMARY OF THE INVENTION

The present invention is directed to an improved screening system employing a partially submerged screening device. The present system employs a horizontally disposed, downwardly concaved screen mounted in a vibratory separator. A chamber extends upwardly around the lower central portion of the screen and during operation is filled with the liquid and liquid borne solid material to partially submerge the screen. A peripheral area around the lower central portion remains above the liquid level in the chamber to receive and dewater oversized material removed from the flow by the screen. The partial submersion of the screen makes the present mechanism useful for water borne solids such as wood pulp in the paper industry.

The advantageous arrangement of the present invention in combination with the modern vibratory screen structure provides substantial advantage both in operation and in permitting the addition of other features. The vibratory separator allows spiral movement of the oversized material from the liquid-solid mixture such that it may be collected about the outer periphery of the device and removed. At the same time, properly sized pulp which is conveyed above the liquid level may still pass through the screen.

To enhance the clearing of the properly sized material through the screen above the water level and to wash adhering properly sized material from the oversized material prior to discharge of the oversized material, a spray manifold and nozzles may be employed. These nozzles may be directed to advantageously work with the vibratory motion to move material on the surface of the screen in the same rotational direction or to partially impede flow for further cleaning. At the same time, the nozzles do not either retard or accellerate movement of material in a radial path.

The device of the present invention may also be advantageously employed to distribute in a central location liquid-solid flow. A mechanism has been devised to reduce the velocity of this flow so as not to adversely affect the operation of the screen.

Accordingly, it is an object of the present invention to provide an improved screening mechanism for liquid borne solids. Other and further objects and advantages will appear hereinafter.

DETAILED DESCRIPTION OF THE PREFERRED EMBODIMENT

Figure 1:
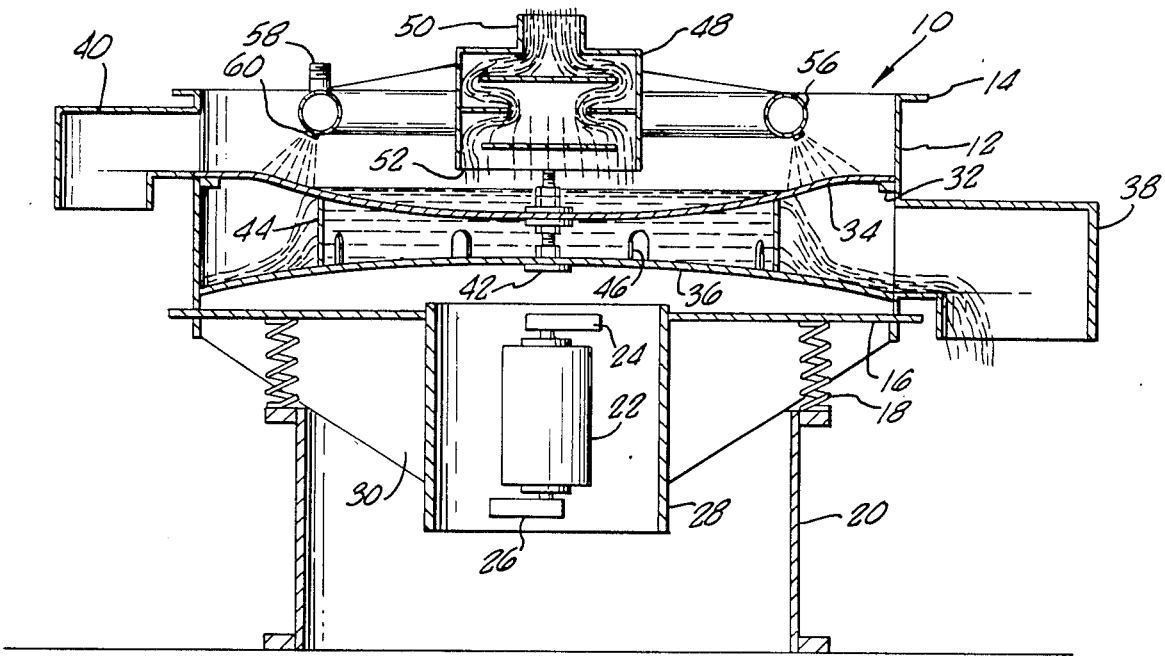
FIG. 1 is a cross-sectional elevation taken through the center of a preferred embodiment of the present invention.
Figure 2:
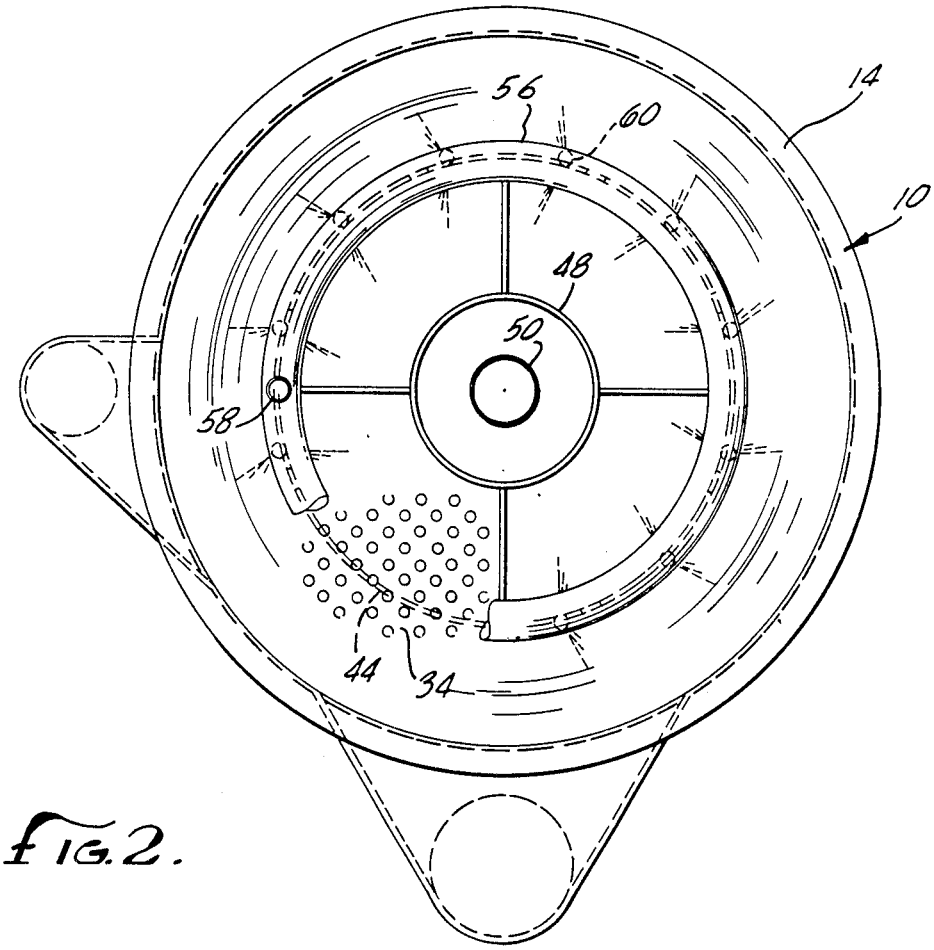
FIG. 2 is a plan view of the mechanism of FIG. 1.

Turning in detail to the drawings, a first preferred embodiment of the present invention is illustrated in FIGS. 1 and 2. The device includes a frame, generally designated 10. This frame includes a cylindrical wall 12, a rigidifying upper flange 14 and a base plate 16. The base plate 16 extends outwardly to the cylindrical wall 12 and has a circular hole located centrally therethrough. The frame 10 is sprung by means of a plurality of springs 18. The springs are in turn positioned on a base 20.

To provide means for inducing vibration of a predetermined nature, a motor 22 with eccentric weights 24 and 26 is mounted to the frame 10. To provide adequate mounting supports, a cylindrical mounting structure 28 is fixed to the base 20 both at the intersection thereof and by means of gussets 30.

Mounted horizontally in the frame 10 on annular mounting flange 32 is a screen 34. The screen 34 is shown to be a perforated plate which is downwardly concaved and circular in plan. The phrase "downardly concaved" is employed to denote a surface, or assembly of surfaces, which is lower in the middle than about the outside. Thus, dished, conical, truncated conical and other, less regular surfaces are contemplated. The screen has been arbitrarily divided for purposes of clarity in the present description into a central lower portion defined as being inwardly of the chamber described below and a peripheral elevated portion outwardly of the chamber. As the screen is all one plate, in the embodiment illustrated, there is surface continuity between portions which is preferable for smooth flow of material from the central portion of the screen. The peripheral elevated portion includes a planar annular segment most adjacent the cylindrical wall 12 and a truncated dished segment defined between the planar annular segment and the central lower portion. Again, a smooth transition between portions provides unimpeded material flow to the outer periphery of the screen.

Located horizontally across the frame 10 beneath the screen 34 is an upwardly convex plate 36. As with "downwardly concaved", "upwardly convex" is intended to encompass a variety of surfaces having the middle thereof higher than the outside. This plate 36 defines the lowermost portion of the screening cavity in the frame 10. By virtue of the position of the plate 36, all flow through the screen 34 is collected and eventually conveyed to outlet 38. Similarly, oversized material on the screen 34 eventually is conveyed to outlet 40. Associated equipment may convey the effluent from each of these outlets 38 and 40 to further processing or disposal.

To retain the screen 34 in position, a tie-down 42 is fixed to the plate 36 and to the screen 34 at its mid point. The tie-down 42 may then be drawn down to fix the screen 34 in position.

Located between the screen 34 and the plate 36 circumferentially about the central lower portion of the screen 34 is an upstanding or cylindrical peripheral wall 44, circular in plan. This wall extends upwardly from the plate 36 to the screen 34 and defines a chamber therein. As the peripheral wall 44 extends upwardly to a position above the central lower portion of the screen 34, a liquid level may be defined above this lowermost portion of the screen. To maintain the liquid level at the top of the chamber and possibly flowing over, chamber outlet means is provided for exhausting the liquid-solid material. In order that the chamber will fill, the outlet means is to be restricted, either on a fixed or variable basis, such that the flow rate therethrough will be less than the flow rate which is capable of entering the chamber through the portion of the screen 34 immediately above the chamber. To this end, small ports 46 have been shown in the preferred embodiment. Other baffle arrangements and the like may be otherwise employed to the same end.

To provide material to the system, an inlet manifold is centrally positioned above the screen 34. This inlet manifold 48 is specifically designed to condition the flow to the screen such that the incoming material will not adversely effect the operation thereof. To this end, the manifold includes an inlet port 50, an outlet port 52 and baffles 54. The outlet port 52 is directly facing the upper surface of the screen 34 in the area where the screen is submerged. The baffles 54 prevent any straight flow between the inlet 50 and the outlet 52 to condition the flow, particularly by reducing its velocity. The cross-sectional open area at the outlet 52 around the lowest baffle is preferably larger than the cross-sectional area of the inlet 50 in order that the velocity may be reduced at the lower point.

Outwardly of the inlet manifold 48 is a spray manifold 56. The spray manifold 56 consists of an annular tube concentrically placed about the center line of the separator above the screen 34. An inlet 58 is provided to receive fresh water, in the case of pulp screening, or other processing liquid. Located about the underside of the spray manifold 56, uniformly spaced, are spray nozzles 60. These spray nozzles are particularly aimed at the edge of the submerged portion of the screen and outwardly therefrom for some distance.

The nozzles 60 are biased, in the embodiment best seen in FIG. 2, in one circular direction at the surface of the screen 34. This direction is preferably in the same circular direction as the induced movement of particles moving in a spiral path both about the screen 34 and outwardly toward the cylindrical wall 12 of the frame 10. However, if additional washing of the fines from the larger separated particles is desired, the nozzles 60 may be biased in the opposite direction. Such a reverse bias may require some attention to the amount and force of the spray such that the spiral motion of the material on the screen, albeit impeded, will not be stopped or reversed.

In operation, the vibratory separator is vibrated by means of the motor 22 and eccentric weights 24 and 26 preferably to provide a spiral flow of material on the surface of the screen 34. In the present embodiment, this flow would be in the counterclockwise direction as seen in FIG. 2. Inlet flow of, for example, water and pulp is passed through the manifold 48 and distributed into the body of liquid and material above the screen 34 where the screen is submerged. The flow is preferably conditioned such that it will not cause undue splashing and other displacement of the liquid maintained in that area.

The liquid and solid material flowing from the manifold 48 is then primarily collected within the confines of the peripheral wall 44. The primary flow is downwardly through the screen 34 such that oversized pieces will be left behind. The rate of flow into the device is preferably such that there will be some overflow over the top of the peripheral wall 44 and through the screen 34 outwardly of that wall. The material passing through the screen 34 inwardly of the peripheral wall 44 is then discharged through ports 46 into the annular space above the plate 36. Eventually, this material is conveyed to the outlet 38 where it is collected for further operation. As this screening takes place, the induced vibration is tending to move all material in a counterclockwise outward spiral. The vibration also helps to prevent binding of the screen 34 by the material which would otherwise pass therethrough.

As the oversized material cannot pass through the screen 34, it eventually moves outwardly to the edge of the central lower portion of the screen. At this point, the oversized material is substantially dewatered. Certain of the acceptable material is also moved by the vibrations outwardly from the central lower portion of the screen. This material moves either independently of the oversized material or is associated with it. The nozzles 60 on the spray manifold 56 act to convey the acceptable material through the screen 34 and to also wash it from the oversized particles and then through the screen. Because of the direction the spray is biased, in the embodiment of FIG. 2, the spray does not impede travel of the oversized particles. These particles eventually move outwardly in a spiral direction to the outer cylindrical wall 12 of the device and then are collected and discharged through the outlet 40.

Figure 3:
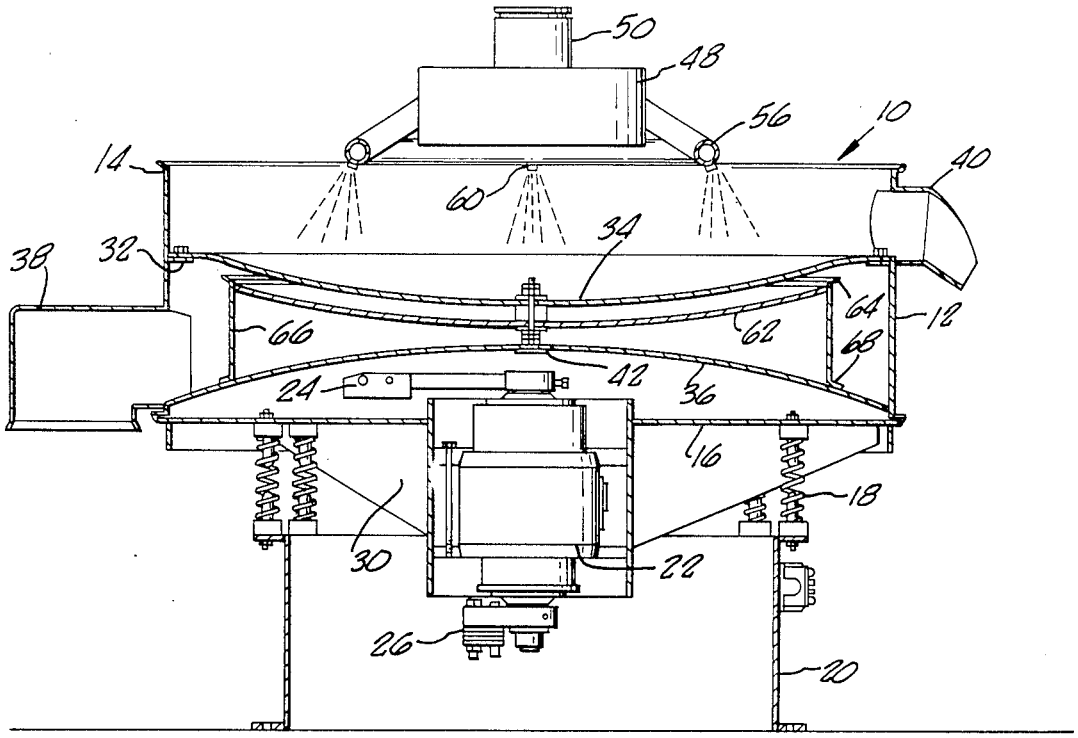
FIG. 3 is a cross-sectional elevation taken through the center of a second preferred embodiment of the present invention.
Figure 4:
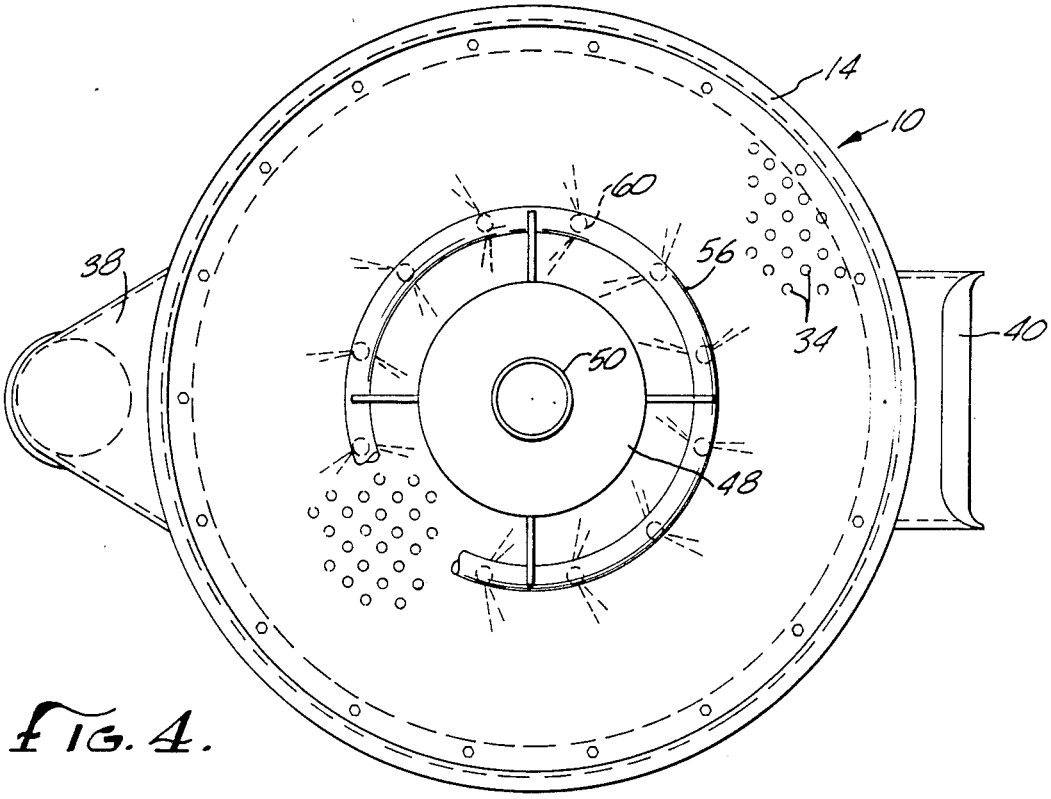
FIG. 4 is a plan view of the mechanism of FIG. 3.

Looking to the second preferred embodiment of the present invention illustrated as FIGS. 3 and 4, the same reference numbers as employed for FIGS. 1 and 2 will be used for identical or substantial identical parts. Reference is made to the earlier description corresponding to such numbers.

Generally speaking, the variation in the two embodiments is presented in the chamber beneath the screen 34. In the embodiment of FIGS. 3 and 4, the chamber beneath the screen is formed by a dished plate 62. The dished plate 62 is circular in plan with an outer rim 64 extending upwardly to a position above the central lower portion of the screen 34. An upstanding cylindrical wall 66 is fixed to the plate 36 and forms a rigid support for the dished plate 62. This cylindrical wall conveniently includes an attachment flange 68 which is secured to the plate 36. Additionally, the lip 64 is shown to be formed as a flange on the upper end of the cylindrical wall 66.

The placement of the dished plate 62 with the outer rim 64 is such that the chamber formed is circumferentially disposed about the lower portion of the screen 34. To provide outlet means for the chamber such that the carrying liquid and suspended material may exit from the chamber and flow to the outlet 38, the plate 62 at the rim 64 is spaced below the most adjacent portion of the screen 34. Thus, an annular outlet is formed between the screen 34 and the outer rim 64. The plate 62 is also configured to assume a concavity similar to that of the screen 34. In this way, a minimum amount of retained mass is achieved without restriction to the flow of material to the rim 64 for discharge.

Thus, a continuous processing of liquid borne solids to remove course material may be effected in the most efficient and advantageous manner by the disclosed system. While embodiments and applications of this application have been shown and described, it would be apparent to those skilled in the art that many more modifications are possible without departing from the inventive concepts herein. The invention, therefore, is not to be restricted except by the spirit of the appended claims.

What is claimed is:

1. A vibratory separator comprising a frame;

spring means for resiliently supporting said frame;

means for inducing vibration in said frame;

a horizontally disposed, downwardly concaved screen mounted in said frame, said concavity defining a central lower portion and a peripheral elevated portion;

a dished plate spaced from the bottom of said screen defining a chamber beneath said screen extending upwardly to an outer rim spaced from the underside of said screen to an elevation above said lower portion of said screen circumferentially about said lower portion; and an annular outlet between said outer rim and the underside of said screen.

2. The vibratory separator of claim 1 wherein said dished plate has a concavity substantially equal to that of said screen.

3. The vibratory separator of claim 1 further comprising a spray manifold positioned above said screen including spray nozzles directed to the upper surface of said screen in an annular pattern on said peripheral elevated portion.

4. The vibratory separator of claim 3 wherein said means for inducing vibration further induces movement of material on said screen in an outwardly spiraling motion, said spray nozzles being biased toward that direction.

5. A vibratory separator comprising a frame;

spring means for resiliently supporting said frame;

means for inducing vibration in said frame;

a downwardly concave screen horizontally mounted in said frame, said screen having a central lower portion and a peripheral elevated portion;

a concave dished plate positioned beneath said screen defining a chamber adjacent said central lower portion, said dished plate having an upper rim spaced from the underside of said screen; and a restricted outlet means formed between the periphery of said upper rim and said underside of said screen.

6. A vibratory separator comprising a frame;

spring means for resiliently supporting said frame;

means for inducing vibration in said frame;

a horizontally disposed, downwardly concaved screen mounted in said frame, said concavity defining a central lower portion and having a peripheral elevated portion;

a wall defining a chamber beneath said screen extending upwardly to an elevation above said lower portion of said screen circumferencially about said lower portions, said wall including an upper rim spaced from said screen; and means for providing a restricted exhausting of said chamber below said screen to allow filling of said chamber, said means including an annular outlet between said upper rim and the underside of said screen.

* * * * *